US006203271B1

(12) United States Patent
Graf et al.

(10) Patent No.: US 6,203,271 B1
(45) Date of Patent: Mar. 20, 2001

(54) SHRINK RING FOR TURBINE WITH BLEEDING

(75) Inventors: Peter Graf, Küssaberg (DE); Tihomir Stojkovic' , Karlovac (HR)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/328,433

(22) Filed: Jun. 9, 1999

(30) Foreign Application Priority Data

Jun. 15, 1998 (EP) ..... 98810543

(51) Int. Cl.[7] ..... F03D 7/00
(52) U.S. Cl. ..... 415/144; 415/169.2; 415/169.4
(58) Field of Search ..... 415/144, 169.2, 415/169.4, 108

(56) References Cited

FOREIGN PATENT DOCUMENTS 2323904 4/1977 (FR) .

600025 4/1946 (GB) .

*Primary Examiner*—Edward K. Look
*Assistant Examiner*—James M McAleenan
(74) *Attorney, Agent, or Firm*—Burns, Doane, Swecker & Mathis, L.L.P.

(57) ABSTRACT

The invention relates to a steam turbine, in particular a high-pressure turbine, which is enclosed by an inner casing, split into a top part and a bottom part, and an outer casing. The steam turbine, for the purpose of bleeding, has a bleed slot, which leads form the blade duct of the steam turbine through the inner casing. According to the invention, the inner casing has a shrink ring, which on the one hand holds together the bottom part and the top part of the inner casing and on the other hand forms an annular space above the bleed slot for the purpose of collecting bleed steam and passing it into a pipe connection. The shrink ring has a cavity in its center and flat sides being adapted to the outer surface of the inner casing. The cavity of the shrink ring, together with the outer surface of the inner casing, forms the enclosed, tight annular space. the shrink ring is distinguished by the few components and a short production and assembly time.

7 Claims, 3 Drawing Sheets

SHRINK RING FOR TURBINE WITH BLEEDING

FIELD OF THE INVENTION

The invention relates to a high-pressure or intermediate-pressure turbine as an individual machine or a combined high-pressure/intermediate-pressure turbine, having an inner casing, consisting of bottom part and top part, and an outer casing, and in particular to a connection between these parts of the inner casing by means of shrink rings as well as to bleeding for diverting steam from the turbine into a pipeline to an apparatus disposed outside the turbine.

BACKGROUND OF THE INVENTION

Turbines whose bottom part and top part of the inner casing are held together by means of the shrink-ring technique are known. This technique has proved successful in turbines having higher pressures and is in particular considered to be cost-effective. The shrink rings are used in those turbines whose taper angles (of the blading duct) are small, namely in high-pressure turbines, intermediate-pressure turbines or combined high-pressure/intermediate-pressure turbines accommodated in a common casing. (In contrast to turbines having higher pressures, flanged or screwed connections are more likely to be used in low-pressure turbines.)

A plurality of such shrink rings are typically arranged at regular intervals. The invention described here, then, relates in particular to the shrink-ring technique in the region of a bleed point of the turbine.

To assist the operation of apparatuses such as feed heaters or a boiler, steam is bled from the turbine and is directed via a pipeline out of the turbine casing to the apparatuses mentioned. To this end, a bleed slot, which leads through the inner casing into the space between inner and outer casings, is arranged at the outer contour of the blade duct of the turbine. The steam flows from the blade duct of the turbine through the bleed slot and is collected in a sealed-off annular space, which is formed above the bleed slot by a cast bleed ring in the form of a collar on the outer surface of the inner casing. This bleed ring is fastened to the inner casing in a sealing manner. Arranged on the ring is a pipe connection which leads through the outer casing to the outside and is connected to a pipeline, which leads to a feed heater, boiler or other thermal apparatus.

The shrink rings and the bleed ring are each fixed to the inner casing by a plurality of bolts and screws, so that the rings cannot be displaced relative to the casing.

A disadvantage with this prior art is that a plurality of components and small parts, which are individually produced and fitted, are required for the bleeding and for holding together the inner casing by means of shrink rings in the region of the bleed point. In particular, the manufacture of a cast bleed ring requires several production steps. Finally, for the many components and small parts required, this means a long fabrication and assembly time and resulting high costs.

SUMMARY OF THE INVENTION

Accordingly, one object of the invention, in view of these disadvantages, is to provide a novel device in the region of the bleed point of a high-pressure or intermediate-pressure turbine for holding together the top part and bottom part of the inner casing of the turbine and for collecting the bleed steam. The inner, as well as the outer, casing of a steam turbine is typically divided along a horizontal plane at the level of the rotor axis into a top and bottom part whereas the top part refers to a top half-shell encompassing the upper 180° and the bottom or lower part refers to a lower half-shell encompassing the lower 180° of the respective casing. The top and bottom parts or half-shells of the casings cooperate with one another by means of the separating plane which lies horizontally and passes through the rotor axis. This device requiring a reduced number of components and its production and fitting being as simple as possible and thus cost-effective.

This object is achieved by a steam turbine according to the preamble of claim 1, which steam turbine, in the region of the bleed point, has a shrink ring, which is arranged above the bleed slot of the turbine and has at the location of the bleed slot a half-open cavity facing the inner casing, the cavity together with the outer surface of the inner casing forming an annular space, in which bleed steam flowing through the bleed slot collects. On both sides of the cavity, the shrink ring is designed to be flat, so that its contours are adapted to those of the inner casing. The shrink ring therefore combines the function of both the shrink ring and the bleed ring in a single part and is designated here as combined shrink ring/bleed ring. Furthermore, the shrink ring has an opening for an extraction connection, which leads out in a sealing manner through the outer casing to a pipeline.

The advantage of the combined shrink ring according to the invention lies in the fact that it consists of a single component, which contains both functions, that of holding together the casing parts of the turbine and that of forming a collecting space for bleed steam from the turbine. Instead of a plurality of parts as in the prior art described at the beginning, only a single part is to be produced and fitted here for these two functions.

The combined shrink ring/bleed ring according to the invention is turned in one operation by means of a forging bush. Since only one large part has to be produced instead of a plurality of parts, the production time is significantly reduced. In particular, cast parts, which require a plurality of cost-intensive working steps, are no longer necessary. The assembly time is likewise reduced, since only one part has to be fitted instead of a plurality of parts. Finally, the number of small parts such as axial fixings is considerably reduced, which saves further time during fitting.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
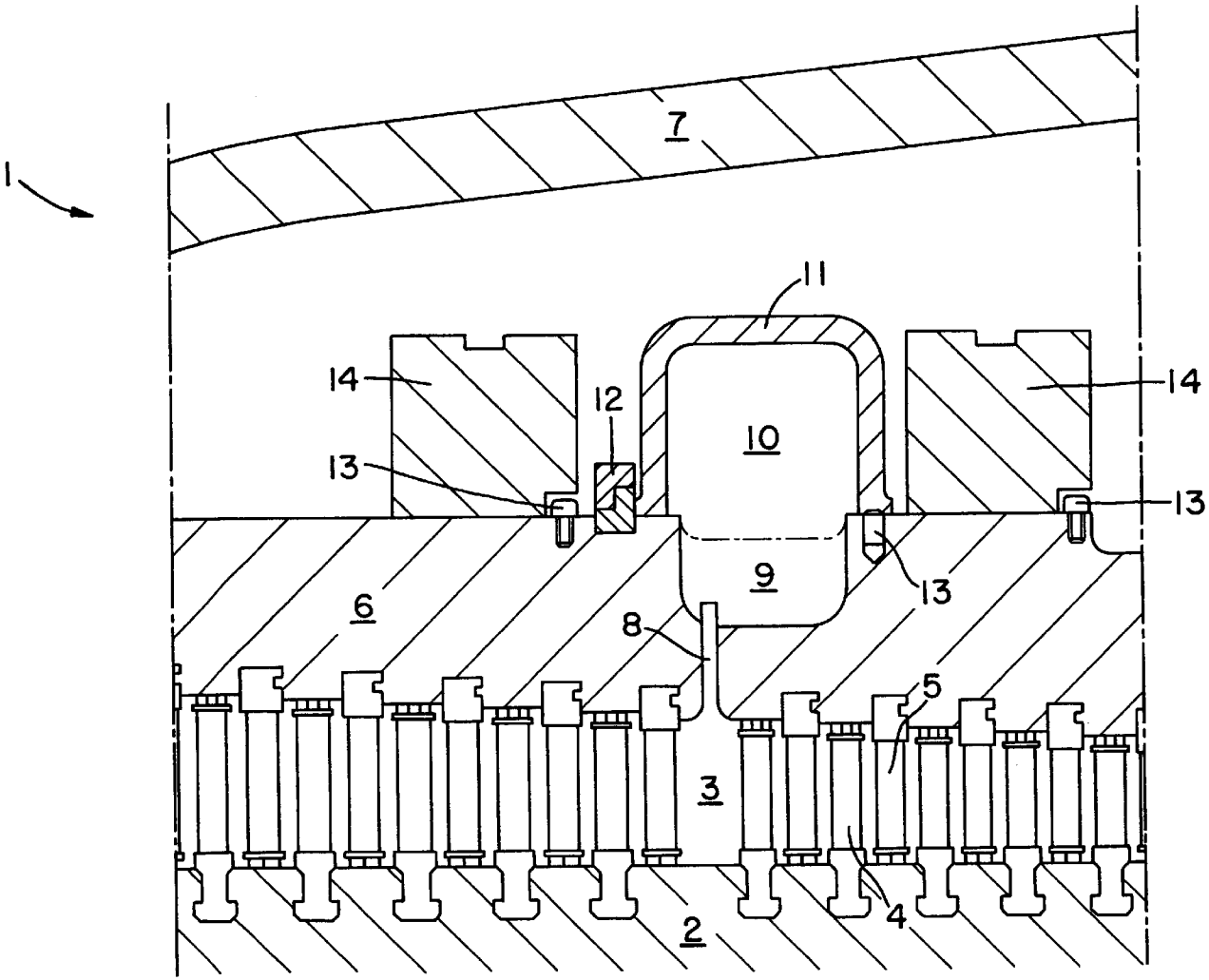
FIG. 1 PRIOR ART
FIG. 1 shows a turbine with shrink rings and bleed ring according to the prior art.

Referring now to the drawings, wherein like reference numerals designate identical or corresponding parts throughout the several views, FIG. 1 shows a steam turbine 1 with bleed ring and shrink ring accoring to the prior art. It has a shaft 2 and a blade duct 3, with moving blades 4 and guide blades 5. The steam turbine 1 is enclosed by an inner casing 6 and an outer casing 7. At the outer contour of the blade duct 3, the steam turbine has a bleed slot 8, which leads over 360° through the inner casing 6 into the space between inner and outer casing 6, 7. The inner casing 6 is held together along the bleed slot 8 by a plurality of ribs 9 distributed over the periphery, of which one is indicated in the figure by chain-dotted line. On the outer surface of the inner casing 6, a cast bleed ring 11 in the form of a collar is arranged at the level of the bleed slot 8, an enclosed, tight annular space 10 being formed above the bleed slot 8 by the bleed ring 11 and the inner casing 6. The bleed ring 11 is fixed to the inner casing 6 by retaining rings 12. Furthermore, a pipe connection (not shown), which leads to the outside through the outer casing 7, is arranged on the bleed ring 11. Bleed steam flows from the blade duct 3 of the steam turbine through the bleed slot 8, collects in the annular space 10 and passes through a pipeline to a feed heater, boiler or other thermal plant.

Furthermore, the inner casing 6 is held together by a plurality of shrink rings 14. These shrink rings 14 as well as the bleed ring 8 are each connected to the inner casing 6 by spring bolts 13, which prevent the rings from rotating relative to the casing.

Figure 2:
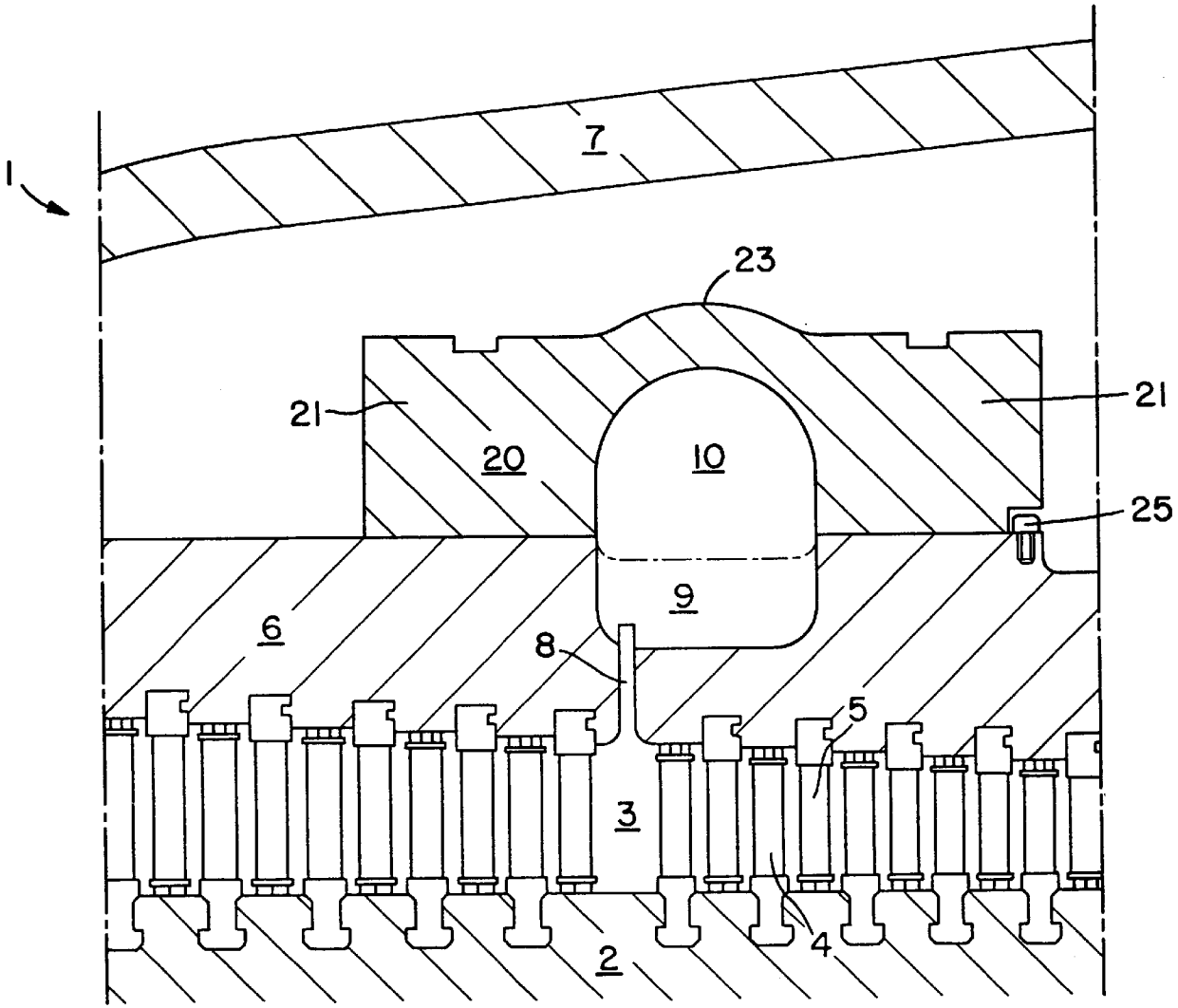
FIG. 2 shows a turbine with combined shrink ring/bleed ring according to the invention.

FIG. 2 shows a steam turbine 1 of a similar type as described in FIG. 1 but having the combined shrink ring/bleed ring according to the invention. The combined shrink ring/bleed ring 20 consists of a single forged part. At the sides 21, the shrink ring 20 is designed to be flat on its inside and is adapted to the outer surface of the inner casing 6, so that the ring 20 joins the inner casing in a sealing manner during the shrinking. In the center, the combined shrink ring/bleed ring 20 has a half-open cavity on the side facing the inner casing 6. During fitting, the ring 20 is pushed over the inner casing 6 of the turbine and arranged in such a way that the cavity comes to lie above the bleed slot 8. In this case, the cavity, together with the outer surface of the inner casing 6, forms a free annular space 10 above the bleed slot 8. During the tapping of steam, the steam flows through the bleed slot 8 and collects and is distributed in the annular space 10. In the embodiment shown, the cavity has a round cross section. Other cross sections, such as polygonal cross sections for example, are also conceivable here. However, a round cross section is the most favorable in view of the flow through the annular space to the pipeline, which leads out of the turbine.

In the embodiment shown, the outer contour has an arch 23, as a result of which a type of bridge from one side part 21 of the combined shrink ring to the other side part 21 is formed. The shrink ring becomes more flexible due to the arched form, a factor which is advantageous during the thermal expansions of the inner casing 6. The straight design of the outer contour of the combined shrink ring/bleed ring 20 is also conceivable and would be simpler from the point of view of production. In comparison, the arch 23 is somewhat more complicated to produce.

When being shrunk on, the combined shrink ring/bleed ring 20 is fixed to the inner casing 6 by a plurality of stops, such as stop screws 25 or pins for example, so that displacements in the axial direction are avoided and the annular space maintains its position above the bleed slot. At the same time, rotation of the ring 20 relative to the inner casing 6 is thereby prevented. These fixings are the only small parts which are required for this combined ring 20. Retaining rings and fixings for individual shrink rings, as in the prior art, are dispensed with.

Figure 3:
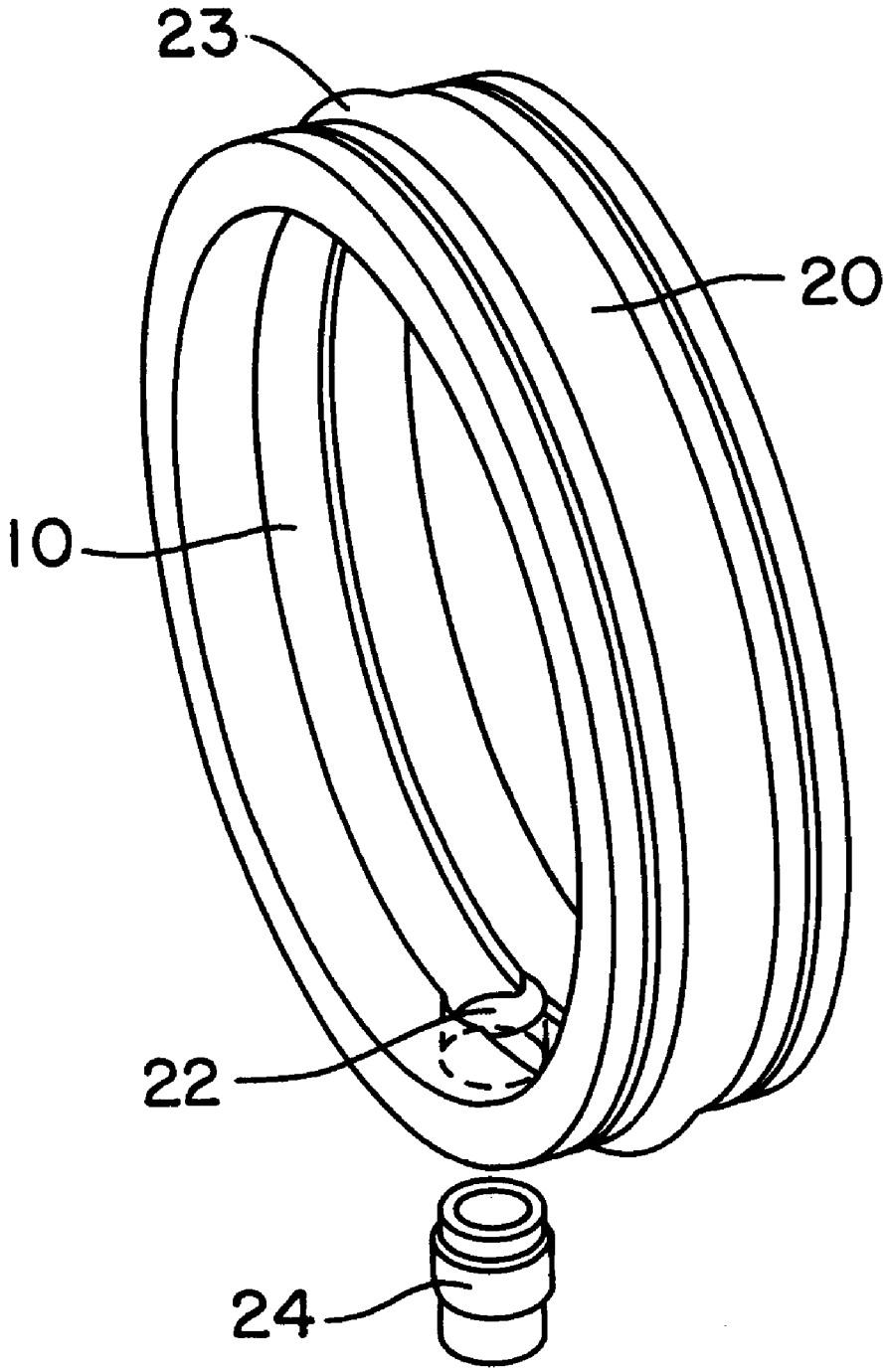
FIG. 3 shows the combined shrink ring/bleed ring according to the invention.

FIG. 3 shows a further view of the combined shrink ring/bleed ring 20. Shown here, again in the center of the ring 20, are the arch 23, the cavity on its inside and the flat parts 21 at the sides of the ring. Arranged in the arch 23 in the bottom region is an opening 22, which serves to fit an extraction connection 24 for directing the bleed steam through the outer casing.

In this case, the opening 22 is designed in such a way that the extraction connection 24 can be arranged vertically. A vertical arrangement simplifies the fitting through the outer casing. The opening preferably lies in the bottom region of the shrink ring/bleed ring 20, so that accumulating condensate can run out if need be. However, an opening in the top region is also conceivable. In FIG. 3, the extraction connection 24 is arranged slightly offset from the bottommost point on the ring. The extraction connection 24 is expediently designed in such a way that the flow from the annular space 10 into the extraction connection 24 is encouraged as far as possible. To this end, the diameter of the extraction connection is at least equal to the width of the cavity, and the end of the extraction connection is also adapted to the contours of the annular space in such a way that no edges project into the annular space. At the joints between the extraction connection and the outside of the inner casing, the extraction connection is welded to the inner casing in a sealing manner. In an alternative embodiment, this connection is realized by screwing or clamping.

Obviously, numerous modifications and variations of the present invention are possible in light of the above teachings. It is therefore to be understood that, within the scope of the appended claims, the invention may be practiced otherwise than as specifically described herein.

What is claimed is:

1. A steam turbine, comprising: an outer casing and an inner casing, which is split along a parting plane into a bottom part and a top part and is held together by means of a plurality of shrink rings, and having a shaft and a blade duct as well as a bleed slot, which leads from the blade duct through the inner casing and through which bleed steam passes into an annular space and flows from there out of the steam turbine through an extraction connection, wherein the inner casing, in a bleed point region, has a combined bleed/shrink ring, which holds together the inner casing and has the annular space in the center of its inner side facing the inner casing, and the combined bleed/shrink ring, on both sides of the cavity, is designed to be flat on its inner side and is adapted there to the contours of the inner casing, and the combined bleed/shrink ring is arranged on the inner casing such that the cavity is positioned above the bleed slot, and at this location the combined bleed/shrink ring together with the outside of the inner casing forms an enclosed and annular space, and bleed steam, which flows from the blade duct through the bleed slot, collects in the annular space and passes from there into an extraction connection.

2. The steam turbine as claimed in claim 1, wherein the half-open cavity in the center of the combined bleed/shrink is of round or polygonal design in its cross section.

3. The steam turbine as claimed in claim 1, wherein the outer contour of the combined bleed/shrink ring has an arch in the center above the annular space.

4. The steam turbine as claimed in claim 3, wherein the combined bleed/shrink ring, to prevent rotation and axial displacements on the inner casing, is positioned on the inner casing by one or more stop screws.

5. The steam turbine as claimed in claim 4, wherein the extraction connection on the combined bleed/shrink ring is fastened in a sealing manner by welding, screwing or clamping.

6. The steam turbine as claimed in claim 5, wherein the combined bleed/shrink ring is fitted on the inner casing in a single fitting operation.

7. A steam turbine, comprising:

an outer casing;

an inner casing detachably connected to the outer casing;

a shaft;

a blade duct;

a bleed slot which leads from the blade duct though the inner casing and allows for bleed steam to pass into a half-open cavity;

a combined bleed/shrink ring which holds together the inner casing, the half-open cavity is located near a center portion of its inner side facing the inner casing, and wherein the combined bleed/shrink ring is designed to be flat on its inner side and communicates with the inner casing; and an extraction connection which communicates with an opening located on an outer periphery of the combined bleed/shrink ring which allows the bleed steam to flow through the opening and out of the steam turbine.

* * * * *